US007629536B2

(12) United States Patent
Stutzman et al.

(10) Patent No.: US 7,629,536 B2
(45) **Date of Patent: *Dec. 8, 2009**

(54) MULTI-PAIR CABLE WITH CHANNELED JACKETS

(75) Inventors: Spring Stutzman, Sidney, NE (US); Dave Wiekhorst, Potter, NE (US); Frederick W. Johnston, Dalton, NE (US); Kamlesh Patel, Bennington, VT (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 26 days.

This patent is subject to a terminal disclaimer.

(21) Appl. No.: 11/891,664

(22) Filed: Aug. 10, 2007

(65) Prior Publication Data

US 2008/0115959 A1 May 22, 2008

Related U.S. Application Data

(63) Continuation of application No. 11/373,819, filed on Mar. 9, 2006, now Pat. No. 7,271,344.

(51) Int. Cl.
*H01B 7/00* (2006.01)

(52) U.S. Cl. ..... 174/113 R; 174/120 R

(58) Field of Classification Search ..... 174/113 R, 174/120 R

See application file for complete search history.

(56) References Cited

U.S. PATENT DOCUMENTS

| | | | |
|---|---|---|---|
| 326,021 | A | 9/1885 | Cruickshank |
| 504,397 | A | 9/1893 | Marsh |
| 1,008,370 | A | 11/1911 | Robillot |
| 2,386,818 | A | 10/1945 | Seavey |
| 2,556,244 | A | 6/1951 | Weston |
| 2,583,026 | A | 1/1952 | Swift |
| 2,690,592 | A | 10/1954 | Schanz |
| 2,708,176 | A | 5/1955 | Rhodes |
| 2,766,481 | A | 10/1956 | Henning |
| 2,804,494 | A | 8/1957 | Fenton |
| 3,035,115 | A | 5/1962 | Heckel et al. |
| 3,064,073 | A | 11/1962 | Downing et al. |
| 3,086,557 | A | 4/1963 | Peterson |
| 3,315,025 | A | 4/1967 | Tomlinson |
| 3,422,648 | A | 1/1969 | Lemelson |
| 3,459,877 | A | 8/1969 | Bullock et al. |
| 3,473,986 | A | 10/1969 | Hureau |
| 3,644,659 | A | 2/1972 | Campbell |
| 3,650,862 | A | 3/1972 | Burr |
| 3,678,177 | A | 7/1972 | Lawrenson |

(Continued)

FOREIGN PATENT DOCUMENTS

| | | |
|---|---|---|
| BE | 539772 | 7/1959 |

(Continued)

*Primary Examiner*—Chau N Nguyen
(74) *Attorney, Agent, or Firm*—Merchant & Gould P.C.

(57) ABSTRACT

A multi-pair cable having a double jacket, including an inner jacket and an outer jacket. The inner and outer jackets each including channels formed on an inner surface. The channeled double jacket of the cable reducing the occurrence of alien crosstalk between adjacent cables by reducing the overall dielectric constant of the cable and increasing the center-to-center distance between adjacent cables. The channeled double jacket of the cable still accommodating existing standard cable connectors.

23 Claims, 5 Drawing Sheets

U.S. PATENT DOCUMENTS 3,771,934 A 11/1973 Delves-Broughton
3,812,282 A 5/1974 Johansson
3,892,912 A 7/1975 Hauck
3,905,853 A 9/1975 Stent
3,911,070 A 10/1975 Lundsager
3,972,970 A 8/1976 Taylor
3,983,313 A 9/1976 Ney et al.
4,050,867 A 9/1977 Ferrentino et al.
4,132,756 A 1/1979 Ferrentino et al.
4,138,457 A 2/1979 Rudd et al.
4,181,486 A 1/1980 Saito
4,321,228 A 3/1982 de Kok
4,370,076 A 1/1983 Sullivan et al.
4,394,705 A 7/1983 Blachman
4,731,505 A 3/1988 Crenshaw et al.
4,745,238 A 5/1988 Kotthaus et al.
4,755,629 A 7/1988 Beggs et al.
4,777,325 A 10/1988 Siwinski
5,042,904 A 8/1991 Story et al.
5,132,488 A 7/1992 Tessier et al.
5,162,120 A 11/1992 Baxter et al.
5,162,609 A 11/1992 Adriaenssens et al.
5,216,204 A 6/1993 Dudek et al.
5,220,130 A 6/1993 Walters
5,286,923 A 2/1994 Prudhon et al.
5,448,669 A 9/1995 Dunn et al.
5,486,654 A 1/1996 Hanak et al.
5,493,071 A 2/1996 Newmoyer
5,514,837 A 5/1996 Kenny et al.
5,541,361 A 7/1996 Friesen et al.
5,563,377 A 10/1996 Arpin et al.
5,742,002 A 4/1998 Arredondo et al.
5,789,711 A 8/1998 Gaeris et al.
5,796,044 A 8/1998 Cobian et al.
5,796,046 A 8/1998 Newmoyer et al.
5,814,768 A 9/1998 Wessels et al.
5,821,467 A 10/1998 O'Brien et al.
5,841,072 A 11/1998 Gagnon
5,922,155 A 7/1999 Clouet et al.
5,952,615 A 9/1999 Prudhon
5,956,445 A 9/1999 Deitz, Sr. et al.
5,969,295 A 10/1999 Boucino et al.
5,990,419 A 11/1999 Bogese, II
6,150,612 A 11/2000 Grandy et al.
6,162,992 A 12/2000 Clark et al.
6,218,621 B1 4/2001 Kuczynski
6,222,130 B1 4/2001 Gareis et al.
6,248,954 B1 6/2001 Clark et al.
6,254,924 B1 7/2001 Brorein et al.
6,271,472 B1 8/2001 Mattos et al.
6,288,340 B1 9/2001 Arnould
6,297,454 B1 10/2001 Gareis
6,303,867 B1 10/2001 Clark et al.
6,310,295 B1 10/2001 Despard
6,355,876 B1 3/2002 Morimoto
6,365,836 B1 4/2002 Blouin et al.
6,441,308 B1 8/2002 Gagnon
6,452,105 B2 9/2002 Badii et al.
6,465,737 B1 10/2002 Bonato et al.
6,476,323 B2 11/2002 Beebe et al.
6,476,326 B1 11/2002 Fuzier et al.
6,506,976 B1 1/2003 Neveux, Jr.
6,534,715 B1 3/2003 Maunder et al.
6,566,605 B1 5/2003 Prudhon
6,570,095 B2 5/2003 Clark et al.
6,573,456 B2 6/2003 Spruell et al.
6,596,944 B1 7/2003 Clark et al.
6,639,152 B2 10/2003 Glew et al.
6,686,537 B1 2/2004 Gareis et al.
6,717,058 B2 4/2004 Booth et al.
6,743,983 B2 6/2004 Wiekhorst et al.
6,770,819 B2 8/2004 Patel
6,787,697 B2 9/2004 Stipes et al.
6,800,811 B1 10/2004 Boucino
6,815,617 B1 11/2004 Gebs et al.
6,818,832 B2 11/2004 Hopkinson et al.
6,844,500 B2 1/2005 Williams et al.
6,855,889 B2 2/2005 Gareis
6,875,928 B1 4/2005 Hayes et al.
6,998,537 B2 2/2006 Clark et al.
7,049,519 B2 5/2006 Wiekhorst et al.
7,145,080 B1 12/2006 Boisvert et al.
7,154,043 B2 12/2006 Clark
7,214,884 B2 5/2007 Kenny et al.
7,271,342 B2 9/2007 Stutzman et al.
7,271,344 B1 9/2007 Stutzman et al.
2001/0001426 A1 5/2001 Gareis et al.
2001/0040042 A1 11/2001 Stipes
2003/0106704 A1 6/2003 Isley et al.
2003/0111241 A1 6/2003 Bahlmann et al.
2003/0168228 A1 9/2003 Eichelberger et al.
2003/0230427 A1 12/2003 Gareis
2004/0035603 A1 2/2004 Clark et al.
2004/0040736 A1 3/2004 Nishimura
2004/0045731 A1 3/2004 Garland
2004/0055777 A1 3/2004 Wiekhorst et al.
2004/0055779 A1 3/2004 Wiekhorst et al.
2004/0055781 A1 3/2004 Cornibert et al.
2004/0149483 A1 8/2004 Glew
2004/0149484 A1 8/2004 Clark
2004/0216913 A1 11/2004 Wiekhorst et al.
2005/0006132 A1 1/2005 Clark
2005/0061536 A1 3/2005 Proulx
2005/0077066 A1 4/2005 Stipes
2005/0167146 A1 8/2005 Wiekhorst et al.
2005/0199415 A1 9/2005 Glew
2005/0269125 A1 12/2005 Clark
2006/0118322 A1 6/2006 Wiekhorst et al.

FOREIGN PATENT DOCUMENTS

CA 524452 5/1956
DE 2133453 1/1973
EP 1 081 720 A1 3/2001
EP 1 548 754 6/2005
GB 725624 3/1955
GB 811703 4/1959
WO WO 2004/029993 4/2004

MULTI-PAIR CABLE WITH CHANNELED JACKETS

CROSS-REFERENCE TO RELATED APPLICATIONS

This application is a continuation of U.S. application Ser. No. 11/373,819, filed Mar. 9, 2006; which application is incorporated herein by reference.

TECHNICAL FIELD

The present disclosure relates generally to cables for use in the telecommunications industry, and various methods associated with such cables. More particularly, this disclosure relates to a telecommunications cable having twisted conductor pairs.

BACKGROUND

Twisted pairs cables include at least one pair of insulated conductors twisted about one another to form a two conductor pair. A number of two conductor pairs can be twisted about each other to define a twisted pair core. A plastic jacket is typically extruded over a twisted pair core to maintain the configuration of the core, and to function as a protective layer. Such cables are commonly referred to as multi-pair cables.

The telecommunications industry is continuously striving to increase the speed and/or volume of signal transmissions through multi-pair cables. One problem that concerns the telecommunications industry is the increased occurrence of alien crosstalk associated with high-speed signal transmissions. In some applications, alien crosstalk problems are addressed by providing multi-pair cables having a layer of electrical shielding between the core of twisted pairs and the cable jacket. Such shielding however is expensive to manufacture; accordingly, unshielded twisted pair cables are more often used.

Without electrical shielding, and with the increase in signal frequencies associated with high-speed transmissions, alien crosstalk can be problematic. Undesired Without electrical shielding, and with the increase in signal frequencies associated with high-speed transmissions, alien crosstalk can be problematic. Undesired crosstalk in a cable is primarily a function of cable capacitance. As a cable produces more capacitance, the amount of crosstalk increases. Capacitance of a cable is dependent on two factors: 1) the center-to-center distance between the twisted pairs of adjacent cables, and 2) the overall dielectric constant of the cables.

SUMMARY

One aspect of the present disclosure relates to a multi-pair cable having a double jacket. The double jacket is arranged and configured to reduce the occurrence of alien crosstalk with an adjacent cable, while still accommodating attachment of existing conventional cable connectors. The double jacket includes two separate inner and outer jackets; the outer jacket increases the center-to-center distance between adjacent cables, yet the outer jacket can be stripped away for attachment of an existing cable connector to the inner jacket. The inner and outer jackets can further include channels that also lessen the occurrence of alien crosstalk by reducing the overall dielectric constant of the multi-pair cable.

A variety of examples of desirable product features or methods are set forth in part in the description that follows, and in part will be apparent from the description, or may be learned by practicing various aspects of the disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

Reference will now be made in detail to various features of the present disclosure that are illustrated in the accompanying drawings. Wherever possible, the same reference numbers will be used throughout the drawings to refer to the same or like parts.

FIGS. 1-9 illustrate embodiments of cables having features that are examples of how inventive aspects in accordance with the principles of the present disclosure may be practiced. Preferred features are adapted for reducing alien crosstalk between adjacent cables.

Figure 1:
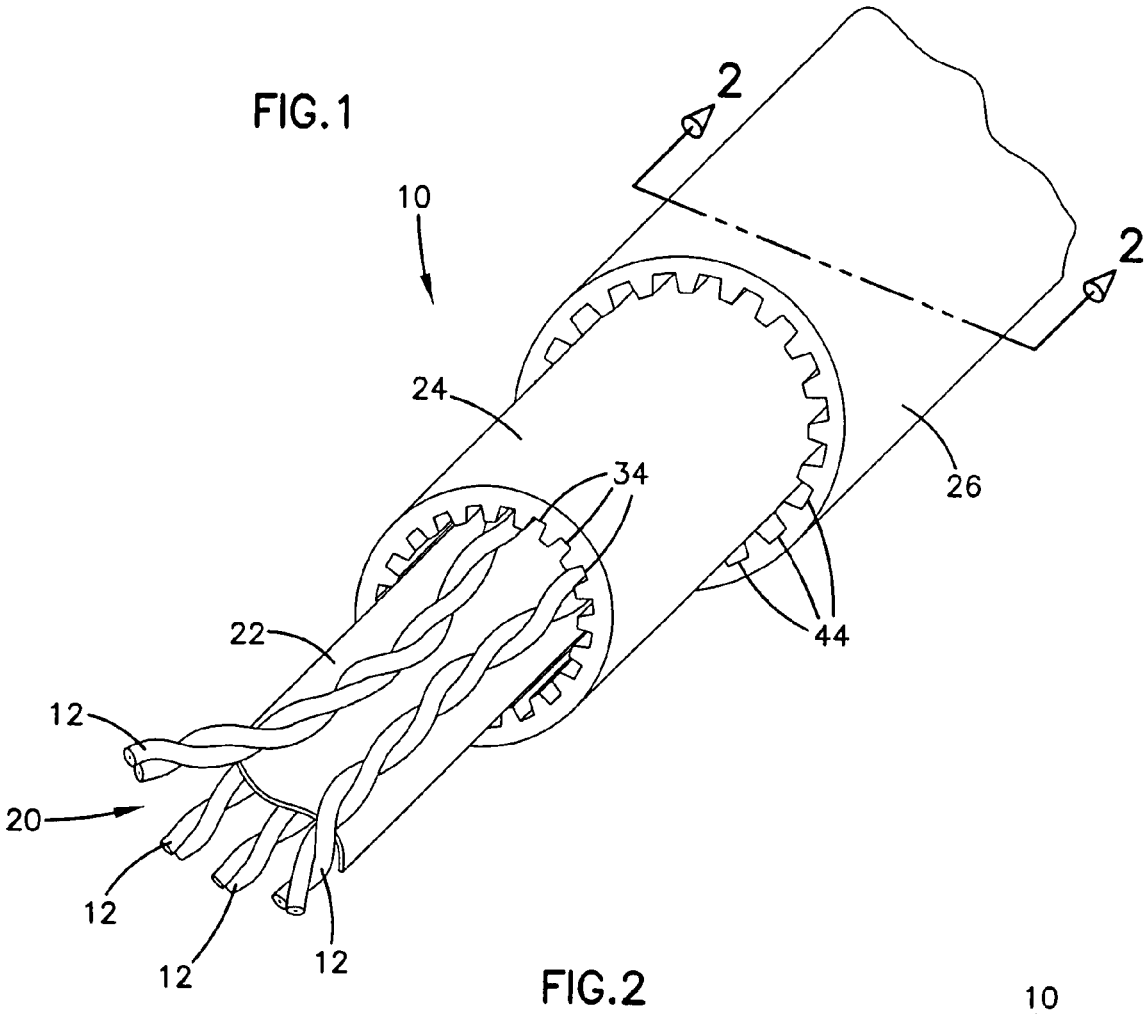
FIG. 1 is a perspective view of one embodiment of a cable according to the principles of the present disclosure.
Figure 2:
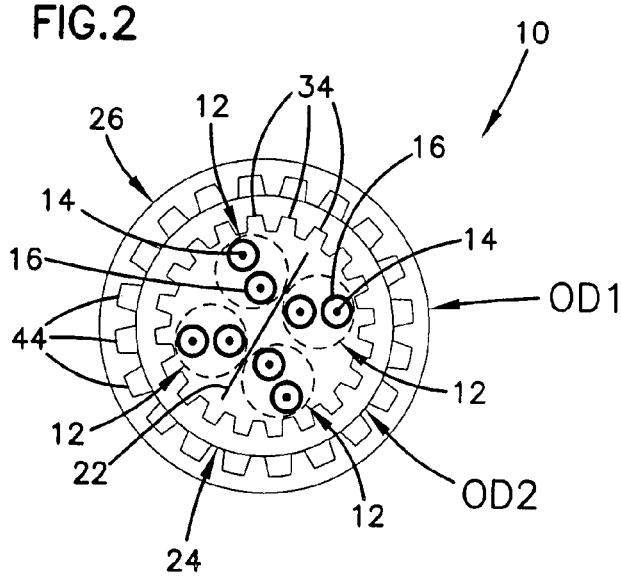
FIG. 2 is a cross-sectional view of the cable of FIG. 1, taken along line 2-2.

Referring to FIG. 1, one embodiment of a cable 10 in accordance with the principles disclosed is illustrated. The cable 10 includes a plurality of twisted pairs 12. In the illustrated embodiment, the cable 10 includes four twisted pairs 12. Each of the twisted pairs includes first and second conductors 14 (FIG. 2) twisted about one another along a central longitudinal axis. Each of the conductors 14 is surrounded by an insulating layer 16 (FIG. 2).

The conductors 14 may be made of copper, aluminum, copper-clad steel and plated copper, for example. It has been found that copper is an optimal conductor material. In addition, the conductor may be made of glass or plastic fiber such that a fiber optic cable is produced in accordance with the principles disclosed. The insulating layer 16 can be made of known materials, such as fluoropolymers or other electrical insulating materials, for example.

The plurality of twisted pairs 12 defines a cable core 20. The cable core 20 can include a separator, such as a flexible tape strip 22, to separate the twisted pairs 12. Other types of separators, including fillers defining pockets that separate and/or retain each of the twisted pairs, can also be used. Further details of example fillers that can be used are described in U.S. patent application Ser. Nos. 10/746,800 and 11/318,350; which applications are incorporated herein by reference.

Each of the conductors 14 of the individual twisted pairs 12 can be twisted about one another at a continuously changing twist rate, an incremental twist rate, or a constant twist rate. Each of the twist rates of the twisted pairs 12 can further be the same as the twist rates of some or all of the other twisted pairs, or different from each of the other twisted pairs. The core 20 of twisted pairs 12 can also be twisted about a central core axis. The core 20 can be similarly twisted at any of a continuously changing, incremental, or constant twist rate.

Referring still to FIG. 1, preferably, the cable 10 includes a double jacket that surrounds the core 20 of twisted pairs 12. In particular, the cable 10 preferably includes both a first inner jacket 24 and a second outer jacket 26. The inner jacket 24 surrounds the core 20 of twisted pairs 12. The outer jacket 26 surrounds the inner jacket 24. The inner and outer jackets 24, 26 not only function to maintain the relative positioning of the twisted pairs 12, the inner and outer jackets 24, 26 also function to lessen the occurrence of alien crosstalk.

In particular, the addition of the outer jacket 26 reduces the capacitance of the cable 10 by increasing the center-to-center distance between the cable 10 and an adjacent cable. Reducing the capacitance by increasing the center-to-center distance between two adjacent cables reduces the occurrence of alien crosstalk between the cables. Accordingly, the outer jacket 26 has an outer diameter OD1 that distances the core 20 of twisted pairs 12 further from adjacent cables than conventional arrangements. Ideally, the cores 20 of twisted pairs 12 of adjacent cables are as far apart as possible to minimize the capacitance between adjacent cables.

There are, however, limits to how far apart the double jacket can place one cable from an adjacent cable. Practical, as well as economical constraints, are imposed on the size of the resulting double jacket cable. A cable cannot be so large that it is impractical to use in an intended environment, and cannot be so large as to preclude use with existing standard connectors. In the illustrated embodiment, the outer diameter OD1 (FIG. 2) of the outer jacket 26 is between about 0.295 inches and 0.310 inches.

The disclosed double jacket is provided as two separate inner and outer jackets 24, 26, as opposed to a single, extra thick jacket layer. This double jacket feature reduces alien crosstalk by distancing the cores of adjacent cables, while at the same time accommodating the design limitations of conventional cable connectors. That is, conventional cable connectors are typically designed to fit a standard size cable jacket. The inner jacket 24 of the present cable 10 is preferably manufactured with an outer diameter OD2 (FIG. 2) that accommodates such existing standard connectors. In use of the present cable 10, a portion of the outer jacket 26 can be stripped away so that a conventional cable connector can be attached to the inner jacket 24. In the illustrated embodiment, the outer diameter OD2 of the inner jacket 24 is between about 0.236 and 0.250 inches.

The diameters of each of the inner jacket 24 and the outer jacket 26 accommodate the practical aspects of standardized telecommunications components, while at the same time address the first factor associated with the capacitance of a cable to reduce the problem of alien crosstalk between adjacent cables. In addition, the present cable 10 further lessens the occurrence of alien crosstalk by addressing the second factor associated with the capacitance of a cable. That is, the inner and outer jackets 24, 26 are designed to reduce an overall dielectric constant of the cable 10 to reduce alien crosstalk. What is meant by "overall" dielectric constant is the combined effective dielectric constant of the cable produced by the combination of the dielectric constants of the cable components.

Figure 3:
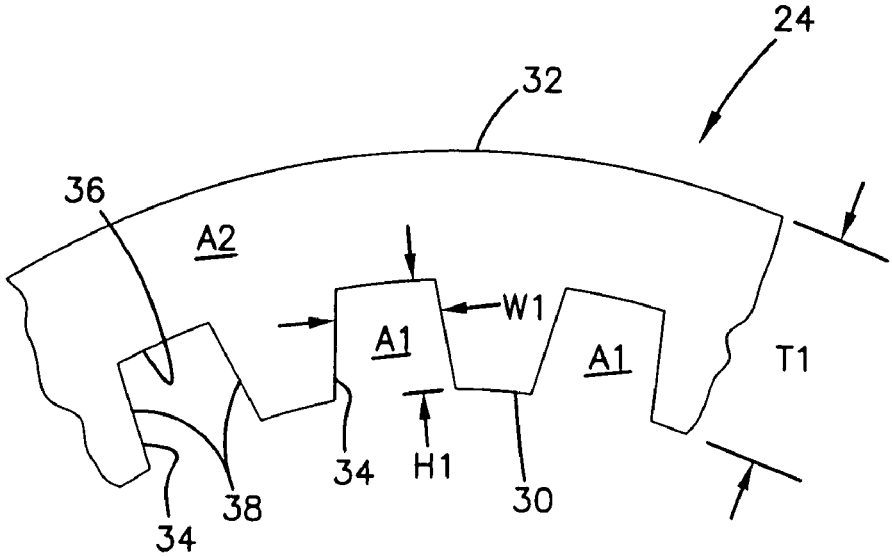
FIG. 3 is a partial view of an inner jacket of the cable of FIG. 2, shown in isolation.

Referring now to FIGS. 2 and 3, the inner jacket 24 of the cable 10 defines an inner surface 30 (FIG. 3) and an outer surface 32. A plurality of splines or channels 34 is formed in the inner surface 30 of the inner jacket 24. The channels each have an open side or a side that is not enclosed by the structure defining the channel, as opposed to a through-hole or bore, for example.

In the illustrated embodiment, the channels 34 have a generally square or splined cross-sectional shape. That is, each channel 34 is defined by three surfaces: a bottom surface 36 (FIG. 3), and two opposing side surfaces 38. The bottom surface 36 opposes the open side of the channel 34. Other cross-sectional channel shapes, such as partial-circle, rectangular, or trapezoidal cross-sectional shapes, can also be provided.

As shown in FIG. 2, the channels 34 are equally spaced about the circumference of the core 20; that is, equally spaced about the inner surface 30 of the jacket 24. In alternative embodiments, the channels may be formed in a pattern or more randomly spaced about the inner surface 30 of the jacket 24. Preferably, the inner jacket 24 includes between 6 and 30 channels spaced apart at approximately 60-degree to 12-degree intervals; more preferably the inner jacket 24 includes between 18 and 26 channels spaced at approximately 20-degree to 14-degree intervals. In the illustrated embodiment, 20 channels are provided at approximately 18-degree intervals. Other numbers of channels, and spatial arrangements, can be provided.

Preferably, the number of channels 34 of the inner jacket 24 is such that a balance of structural stability and reduced overall dielectric constant is achieved. That is, the inner jacket 24 preferably has enough channels to reduce the overall dielectric constant of the cable, as will be described in greater detail hereinafter; yet still has enough structure to adequately support and retain the core 20 of twisted pairs 12.

The inner jacket 24 has an associated dielectric constant dictated by the type of material used to manufacture the jacket. Common materials used for jackets include plastic materials, such as fluoropolymers (e.g. ethylenechlorotrifluorothylene (ECTF) and Flurothylenepropylene (FEP)), polyvinyl chloride (PVC), polyethelene, or other electrically insulating materials, for example. Such materials commonly have a dielectric constant of approximately 2.0. Although a dielectric constant of 2.0 is not ideal, these materials are used because of their cost effectiveness and/or flame retardancy. Flame retardancy of the jacket material is important. Preferably, the material does not propagate flames or generate a significant amount of smoke.

The inner jacket 24 is configured to reduce the overall dielectric constant of the cable 10. Referring now to FIG. 3, each of the channels 34 has a cross-sectional area A1. The cross sectional areas A1 of each channel 34 are preferably sized to compensate for the less-than-ideal dielectric constant of the jacket material. In the illustrated embodiment, the generally square shaped channels 34 have a height H1 and a width W1. The height H1 is preferably between about 0.005 and 0.015 inches; and the width W1 is preferably between about 0.008 and 0.012 inches. The total cross-sectional area A1 defined by the height H1 and the width W1 of each channel 34 can be, accordingly, up to 0.0054 square inches. In the illustrated embodiment, the total cross-sectional area A1, defined by a height H1 of 0.007 inches, a width W1 of 0.010 inches, and a total of 20 channels, is about 0.0014 square inches.

As shown in FIG. 3, the inner jacket 24 has a primary thickness T1 defined between the inner surface 30 and the outer surface 32 of the jacket 24. Preferably, the thickness T1 is between about 0.030 and 0.036 inches. In the illustrated embodiment, the thickness T1 is approximately 0.033 inches.

Subtracting the cross-sectional area A1 of each of the channels 34 from the area defined by the primary thickness T1 defines the cross-sectional area A2 of the inner jacket 24. In the illustrated embodiment, the cross-sectional area A2 of the inner jacket 24 is approximately 0.022 square inches.

The cross-sectional area A2 of the inner jacket 24 and the cross-sectional area A1 of the channels 34 both contribute to the overall dielectric constant of the cable 10. For example, the dielectric properties of the particular inner jacket 24 material (taken as a solid) in combination with the dielectric properties of the material/medium contained within the channels 34 contribute to the overall dielectric constant of the cable 10.

The actual dielectric constants of the preferred jacket material and the preferred medium contained within the channels is described in greater detail hereinafter. The inner jacket 24 is configured such that a ratio of the cross-sectional area A2 of the inner jacket 24 and the cross-sectional area A1 of the channels 34 provides a sufficient reduction in the overall dielectric properties of the cable 10 to reduce the occurrence of alien crosstalk.

In general, preferably, the overall dielectric constant of the cable 10 is no greater than about 1.8 and as close as possible to 1.0. The closer the dielectric constant is to 1.0, the higher the frequencies at which the cable can be used without problematic alien crosstalk. As previously described, common jacket materials have a dielectric constant close to 2.0. Air has a dielectric constant of 1.0. To reduce the overall dielectric constant of the cable 10, the cross-sectional areas A1 of the channels 34 of the inner jacket 24 preferably introduce as much air as possible. Yet, the inner jacket 24 must also have enough structure to protect and support the core 20 of twisted pairs 12. Preferably, the ratio of the cross-sectional areas A2/A1 is no greater than 20:1. In the illustrated embodiment, the ratio A2/A 1 is approximately 16:1.

The ratio defined by the medium within the channels 34 (e.g., air having a dielectric constant of 1.0) and the structure of the inner jacket 24 reduces the dielectric constant contributed by the jacket 24. That is, the inclusion of channels 34 containing air having a lower dielectric constant than that of the jacket material lowers the overall dielectric constant of the cable 10. The reduction of the overall dielectric constant of the cable 10 in turn reduces the occurrence of alien crosstalk and improves the quality of high-speed signal transmission through the cable 10.

The channels 34 of the inner jacket 24 can include medium or materials other than air, such as other gases or polymers. Preferably, the material contained within the channels 34 has a different dielectric constant from that of the material of the jacket 24 (i.e., a lesser dielectric constant) to reduce the overall dielectric constant of the cable 10.

Figure 4:
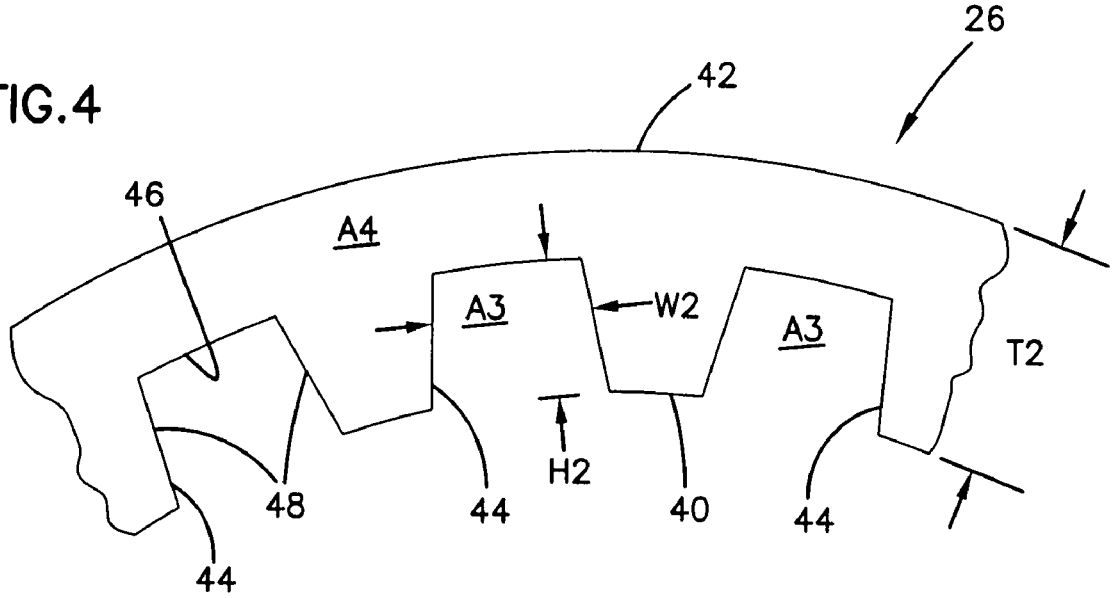
FIG. 4 is a partial view of an outer jacket of the cable of FIG. 2, shown in isolation.

Referring now to FIGS. 2 and 4, the outer jacket 26 of the cable 10 has a similar channeled construction as the inner jacket 24. The outer jacket 26 defines an inner surface 40 (FIG. 4) and an outer surface 42. A plurality of splines or channels 44 is formed in the inner surface 40 of the outer jacket 26. In the illustrated embodiment, the channels 44 of the outer jacket 26 have the same cross-sectional shape as the channels 34 of the inner jacket 24. That is, each channel 44 has a generally square or splined cross-sectional shape defined by a bottom surface 46 (FIG. 4), and two opposing side surfaces 48.

As shown in FIG. 2, the channels 44 of the outer jacket 26 are equally spaced about the inner surface 40 of the jacket 26. In alternative embodiments, the channels may be formed in a pattern or more randomly spaced about the inner surface 40 of the jacket 26. Preferably, the outer jacket 26 includes between 6 and 30 channels spaced apart at approximately 60-degree to 12-degree intervals; more preferably the outer jacket 26 includes between 18 and 26 channels spaced at approximately 20-degree to 14-degree intervals. In the illustrated embodiment, 20 channels are provided at approximately 18-degree intervals. Other numbers of channels, and spatial arrangements, can be provided.

The outer jacket 26 has an associated dielectric constant dictated by the type of material used to manufacture the jacket. Materials that can be used for the outer jacket include plastic materials, such as fluoropolymers (e.g. ethylenechlorotrifluorothylene (ECTF) and Flurothylenepropylene (FEP)), polyvinyl chloride (PVC), polyethelene, or other electrically insulating materials, for example. As previously described, such materials commonly have a dielectric constant of approximately 2.0. Preferably, the material is flame retardant and does not propagate flames or generate a significant amount of smoke.

Similar to the inner jacket 24, the outer jacket 26 is configured to reduce the overall dielectric constant of the cable 10. Referring now to FIG. 4, each of the channels 44 has a cross-sectional area A3. The cross sectional areas A3 of each channel 44 are preferably sized to compensate for the less-than-ideal dielectric constant of the outer jacket material. In the illustrated embodiment, the generally square shaped channels 44 have a height H2 and a width W2. The height H2 is preferably between about 0.005 and 0.015 inches; and the width W2 is preferably between about 0.010 and 0.014 inches. The total cross-sectional area A3 defined by the height H2 and the width W2 of each channel 44 can be, accordingly, up to 0.0063 square inches. In the illustrated embodiment, the total cross-sectional area A3, defined by a height H2 of 0.007 inches, a width W2 of 0.012 inches, and a total of 20 channels, is about 0.0017 square inches.

As shown in FIG. 4, the outer jacket 26 has a primary thickness T2 defined between the inner surface 40 and the outer surface 42 of the jacket 26. Preferably, the thickness T2 is between about 0.030 and 0.036 inches. In the illustrated embodiment, the thickness T2 is approximately 0.034 inches. Subtracting the cross-sectional area A3 of each of the channels 44 from the area defined by the primary thickness T2 defines the cross-sectional area A4 of the outer jacket 26. In the illustrated embodiment, the cross-sectional area A4 of the outer jacket 26 is approximately 0.033 square inches.

As previously described, the cross-sectional area A4 of the outer jacket 26 and the cross-sectional area A3 of the channels 44 both contribute to the overall dielectric constant of the cable 10. The outer jacket 26 is configured such that a ratio of the cross-sectional area A4 of the outer jacket 26 and the cross-sectional area A3 of the channels 44 produces a sufficient reduction in the overall dielectric properties of the cable 10 to reduce the occurrence of alien crosstalk. Preferably, the ratio of the cross-sectional areas A4/A3 of the outer jacket 26 is no greater than 20:1. In the illustrated embodiment, the ratio of A4/A3 is approximately 18:1.

Similar to the ratio of the inner jacket 24, the ratio defined by the medium within the channels 44 (e.g., air having a dielectric constant of 1.0) and the structure of the outer jacket 26 reduces the dielectric constant contributed by the jacket 26. That is, the inclusion of channels 44 containing air having a lower dielectric constant than that of the jacket material lowers the overall dielectric constant of the cable 10. The reduction of the overall dielectric constant of the cable 10 in turn reduces the occurrence of alien crosstalk and improves the quality of high-speed signal transmission through the cable 10.

The channels 44 of the outer jacket 26 can also include medium or materials other than air, such as other gases or polymers. The channels 34 and 44 of each of the jackets 24, 26 can further contain materials that are the same or different from one another.

Figure 5:
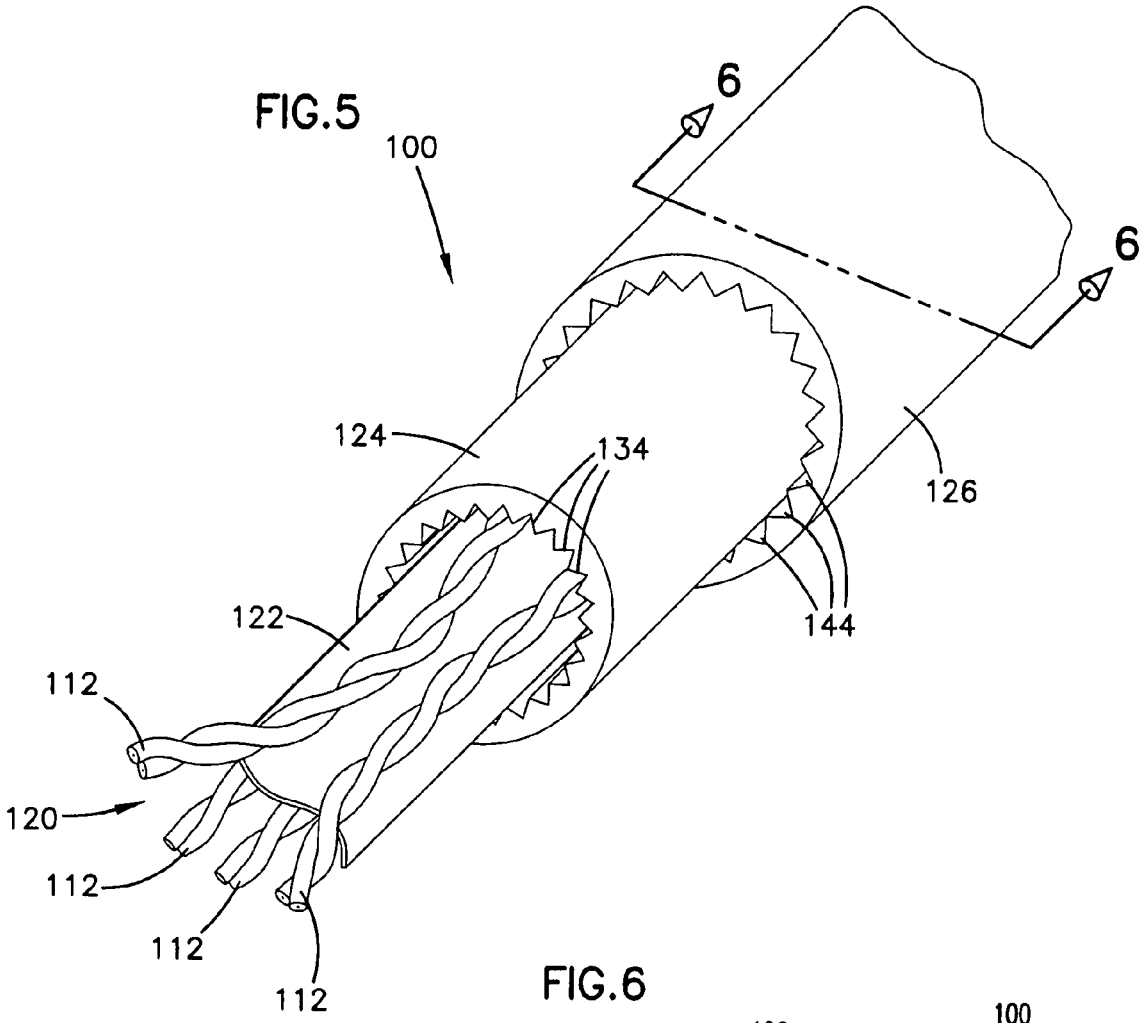
FIG. 5 is a perspective view of another embodiment of a cable according to the principles of the present disclosure.

Referring now to FIG. 5, another embodiment of a cable 100 having features adapted for reducing alien crosstalk between adjacent cables is illustrated. Similar to the previous embodiment, the cable 100 includes a plurality of twisted pairs 112. The plurality of twisted pairs 112 defines a cable core 120. The cable core 120 further includes a flexible tape strip 122 that separates the twisted pairs 112. The alternative twisting configurations of the core and the twisted pairs previously described with respect to the first embodiment apply similarly to the present embodiment.

The cable 100 includes a double jacket that surrounds the core 120 of twisted pairs 112. In particular, the cable 100 preferably includes both a first inner jacket 124 and a second outer jacket 126. The inner jacket 124 surrounds the core 120 of twisted pairs 112. The outer jacket 126 surrounds the inner jacket 124.

The inner and outer jackets 124, 126 are similar in construction, material, and use, as described with respect to the inner and outer jackets 24, 26 of the first cable embodiment 10; with the exception of the shape of the jacket channels (i.e. 134, 144). For example, the outer jacket 126 has an outer diameter OD3 (FIG. 6) of between about 0.295 and 0.310 inches; and the inner jacket 124 has an outer diameter OD4 of between about 0.236 and 0.250 inches Referring now to FIGS. 6 and 7, the inner jacket 124 of the cable 100 defines an inner surface 130 (FIG. 7) and an outer surface 132. A plurality of channels 134 is formed in the inner surface 130 of the inner jacket 124. In the illustrated embodiment, the channels 134 have a generally triangular cross-sectional shape. That is, each channel 134 is defined by two side surfaces 138 that join at an apex 136. The apex 136 opposes the open side (or base) of the triangular shaped channel 134.

Figure 6:
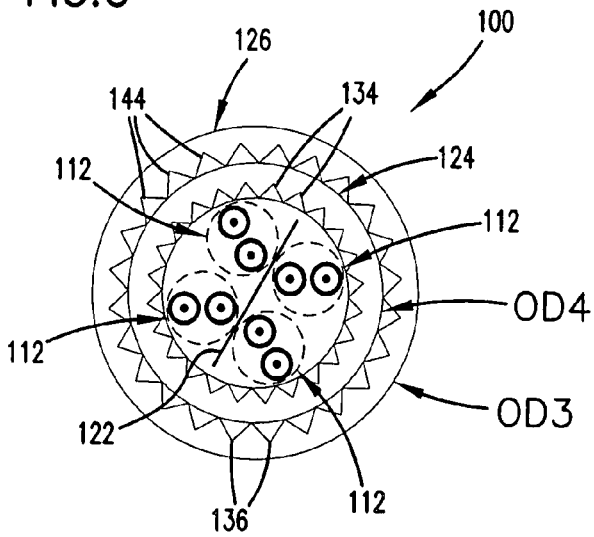
FIG. 6 is a cross-sectional view of the cable of FIG. 5, taken along line 6-6.

As shown in FIG. 6, the channels 134 are equally spaced about the circumference of the core 120; that is, equally spaced about the inner surface 130 of the jacket 124. In alternative embodiments, the channels may be formed in a pattern or more randomly spaced about the inner surface 130 of the jacket 124. Preferably, the inner jacket 124 includes between 6 and 30 channels spaced apart at approximately 60-degree to 12-degree intervals; more preferably the inner jacket 124 includes between 18 and 26 channels spaced at approximately 20-degree to 14-degree intervals. In the illustrated embodiment, 24 channels are provided at approximately 15-degree intervals. Other numbers of channels, and spatial arrangements, can be provided.

Preferably, the number of channels 134 of the inner jacket 124 is such that a balance of structural stability and reduced overall dielectric constant is achieved. That is, the inner jacket 124 preferably has enough channels to reduce the overall dielectric constant of the cable; yet still has enough structure to adequately support and retain the core 120 of twisted pairs 112.

Figure 7:
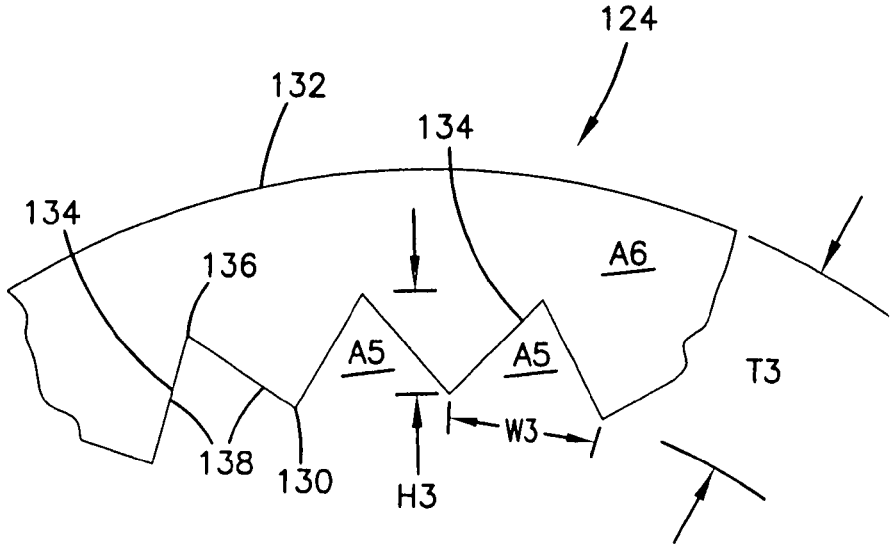
FIG. 7 is a partial view of an inner jacket of the cable of FIG. 6, shown in isolation.

Still referring to FIG. 7, in the illustrated embodiment, the generally triangular shaped channels 134 have a height H3 and a base or width W3. The height H3 is preferably between about 0.006 and 0.010 inches; and the width W3 is preferably between about 0.020 and 0.030 inches. The total cross-sectional area A5 defined by the height H3 and the width W3 of each channel 134 can be, accordingly, up to 0.0045 square inches. In the illustrated embodiment, the total cross-sectional area A5, defined by a height H3 of 0.008 inches, a width W3 of 0.025 inches, and a total of 24 channels, is about 0.0024 square inches.

As shown in FIG. 7, the inner jacket 124 has a primary thickness T3 defined between the inner surface 130 and the outer surface 132 of the jacket 124. Preferably, the thickness T3 is between about 0.030 and 0.036 inches. In the illustrated embodiment, the thickness T3 is between approximately 0.034 inches. Subtracting the cross-sectional area A5 of each of the channels 134 from the area defined by the primary thickness T3 defines the cross-sectional area A6 of the inner jacket 124. In the illustrated embodiment, the cross-sectional area A6 of the inner jacket 124 is approximately 0.022 square inches.

The cross-sectional area A6 of the inner jacket 124 and the cross-sectional area A5 of the channels 134 both contribute to the overall dielectric constant of the cable 100. In general, the overall dielectric constant of the cable 100 is preferably no greater than about 1.8 and as close as possible to 1.0. The inner jacket 124 is configured such that a ratio of the cross-sectional area A6 of the inner jacket 124 and the cross-sectional area A5 of the channels 134 provides a sufficient reduction in the overall dielectric properties of the cable 100 to reduce the occurrence of alien crosstalk. Preferably, the ratio of the cross-sectional areas A6/A5 is no greater than 20:1. In the illustrated embodiment, the ratio A6/A5 is approximately 9:1.

Figure 8:
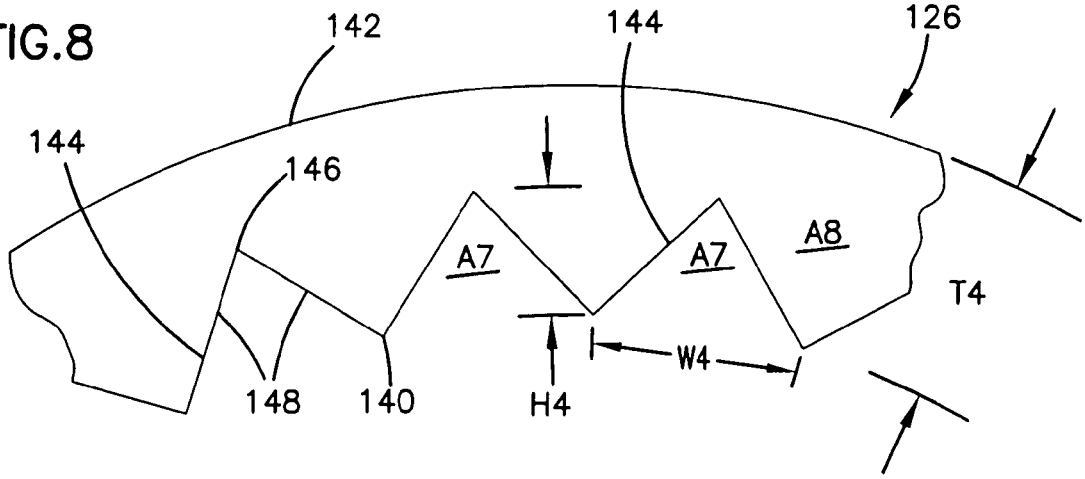
FIG. 8 is a partial view of an outer jacket of the cable of FIG. 6, shown in isolation.

Referring now to FIGS. 6 and 8, the outer jacket 126 of the cable 100 has a similar channeled construction as the inner jacket 124. The outer jacket 126 defines an inner surface 140 (FIG. 8) and an outer surface 142. A plurality of channels 144 is formed in the inner surface 140 of the outer jacket 126. In the illustrated embodiment, the channels 144 of the outer jacket 126 have the same cross-sectional shape as the channels 134 of the inner jacket 124. That is, each channel 144 has a generally triangular cross-sectional shape defined by two opposing side surfaces 148 that join at an apex 146.

As shown in FIG. 6, the channels 144 of the outer jacket 126 are equally spaced about the inner surface 140 of the jacket 126. In alternative embodiments, the channels may be formed in a pattern or more randomly spaced about the inner surface 140 of the jacket 126. Preferably, the outer jacket 126 includes between 6 and 30 channels spaced apart at approximately 60-degree to 12-degree intervals; more preferably the outer jacket 126 includes between 18 and 26 channels spaced at approximately 20-degree to 14-degree intervals. In the illustrated embodiment, 24 channels are provided at approximately 15-degree intervals. Other numbers of channels, and spatial arrangements, can be provided.

Referring to FIG. 8, each of the channels 144 has a cross-sectional area A7. The cross sectional areas A7 of each channel 144 are preferably sized to compensate for the less-than-ideal dielectric constant of the outer jacket material. In the illustrated embodiment, the generally triangular shaped channels 144 have a height H4 and a base or width W4. The height H4 is preferably between about 0.006 and 0.010 inches; and the width W4 is preferably between about 0.027 and 0.035 inches. The total cross-sectional area A7 defined by the height H4 and the width W4 of each channel 144 can be, accordingly, up to 0.0053 square inches. In the illustrated embodiment, the total cross-sectional area A7, defined by a height H4 of 0.008 inches, a width W4 of 0.032 inches, and a total of 24 channels, is about 0.003 square inches.

As shown in FIG. 8, the outer jacket 126 has a primary thickness T4 defined between the inner surface 140 and the outer surface 142 of the jacket 126. Preferably, the thickness T4 is between about 0.030 and 0.036 inches. In the illustrated embodiment, the thickness T4 is approximately 0.033 inches. Subtracting the cross-sectional area A7 of each of the channels 144 from the area defined by the primary thickness T4 defines the cross-sectional area A8 of the outer jacket 126. In the illustrated embodiment, the cross-sectional area A8 of the outer jacket 126 is approximately 0.029 square inches.

As previously described, the cross-sectional area A8 of the outer jacket 126 and the cross-sectional area A7 of the channels 144 both contribute to the overall dielectric constant of the cable 100. The outer jacket 126 is configured such that a ratio of the cross-sectional area A8 of the inner jacket 126 and the cross-sectional area A7 of the channels 144 produces a sufficient reduction in the overall dielectric properties of the cable 100 to reduce the occurrence of alien crosstalk. Preferably, the ratio of the cross-sectional areas A8/A7 is no greater than 20:1. In the illustrated embodiment, the ratio A8/A7 is approximately 9:1.

The channels 34, 44, 134, 144 formed in the jackets of the presently disclose cables 10, 100 are distinguished from other jacket or insulation layers that may contain air due to the porous property of the jacket or layer. For example, the presently described jackets having channels differ from foam insulation, which has closed-cell air pockets within the insulation. Foam insulation is difficult to work with and requires specialized, expensive equipment. Foam insulation also tends to be unstable because foaming does not produce uniform pockets throughout the insulation thereby producing unpredictable performance characteristics. The present cable overcomes these problems.

Figure 9:
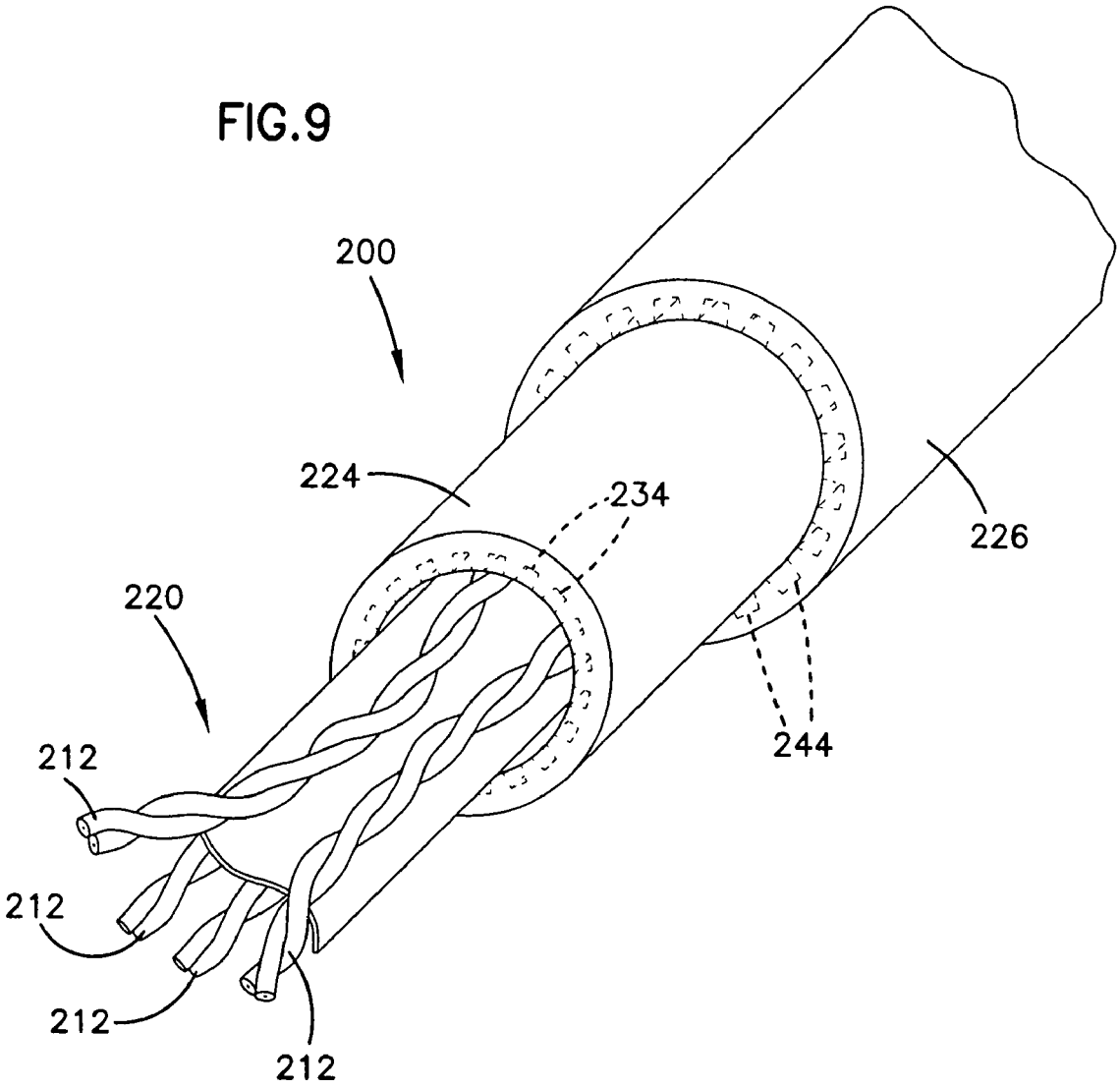
FIG. 9 is a perspective view of still another embodiment of a cable according to the principles of the present disclosure.

Referring now to FIG. 9, yet another embodiment of a cable 200 having features adapted for reducing alien crosstalk between adjacent cables is illustrated. Similar to the previous embodiment, the cable 200 includes a plurality of twisted pairs 212. The plurality of twisted pairs 212 defines a cable core 220. The cable 200 includes a double jacket that surrounds the core 220 of twisted pairs 212. In particular, the cable 200 preferably includes both a first inner jacket 224 and a second outer jacket 226. The inner jacket 224 surrounds the core 220 of twisted pairs 212. The outer jacket 226 surrounds the inner jacket 224.

The inner and outer jackets 224, 226 are similar in construction, material, and use, as described with respect to the inner and outer jackets of the first and second cable embodiments 10, 100; with the exception of the channels. In particular, the double jacket of the cable 200 can include channels in only one of the inner and outer jackets 224, 226. In FIG. 9, the channels 234, 236, shown as having a generally square or splined cross-sectional configuration, are represented in dashed line, as either one of the inner and outer jackets 234, 236 can be manufacture without the channels. As can be understood, one of the inner and outer jackets 234, 236 can likewise be manufactured with triangular channels while the other is manufactured without any channels.

In yet another alternative embodiment, both of the inner and outer jackets 224, 226 can be manufactured without channels. In an embodiment having a double jacket without any channels, capacitance of the cable 200 is reduced simply by the increase in the center-to-center distance from an adjacent cable, to thereby reduce alien crosstalk between the adjacent cables.

The above specification provides a complete description of the present invention. Since many embodiments of the invention can be made without departing from the spirit and scope of the invention, certain aspects of the invention reside in the claims hereinafter appended.

What is claimed is:

1. A multi-pair cable, comprising:

a) a cable core including a plurality of twisted pairs, each of the twisted pairs including a first conductor surrounded by an insulating layer and a second conductor surrounded by an insulating layer, the cable core defining a central axis;

b) an inner jacket surrounding the cable core, the inner jacket being made of an insulating plastic material, the inner jacket having an interior surface and an exterior surface, the inner jacket including channels formed in the interior surface of the inner jacket; and c) an outer jacket surrounding the inner jacket, the outer jacket having an interior surface and an exterior surface, the interior surface of the outer jacket contacting the exterior surface of the inner jacket, the outer jacket including channels formed in the interior surface of the outer jacket;

d) wherein each of the inner and outer jackets is concentrically located in relation to one another.

2. The cable of claim 1, wherein each of the channels of the outer jacket has the same cross-sectional area.

3. The cable of claim 1, wherein the channels of the inner jacket and the channels of the outer jacket have a generally square cross-sectional shape.

4. The cable of claim 1, wherein the channels of the inner jacket and the channels of the outer jacket have a triangular cross-sectional shape.

5. The cable of claim 1, wherein the channels of the outer jackets are equally spaced about the interior surface of the outer jacket.

6. The cable of claim 1, wherein the outer jacket has an outer diameter of between about 0.295 and 0.310 inches.

7. The cable of claim 6, wherein the inner jacket has an outer diameter of between about 0.236 and 0.250 inches.

8. The cable of claim 1, wherein each of the inner jacket and the outer jacket has a thickness of between about 0.030 and 0.036 inches.

9. The cable of claim 1, wherein the outer jacket includes between 18 and 26 channels formed in the interior surface of the outer jacket.

10. The cable of claim 1, wherein the cable core further includes a separator that separates at least some of the twisted pairs from others of the twisted pairs.

11. The cable of claim 10, wherein the separator includes a flexible tape strip.

12. A multi-pair cable, comprising:

a) a cable core including a plurality of twisted pairs, each of the twisted pairs including a first conductor surrounded by an insulating layer and a second conductor surrounded by an insulating layer, the cable core defining a central axis;

b) an inner jacket surrounding the cable core, the inner jacket being made of an insulating plastic material, the inner jacket having an interior surface and an exterior surface, the inner jacket including channels formed in the interior surface of the inner jacket;

c) an outer jacket surrounding the inner jacket, the outer jacket having an interior surface and an exterior surface, the interior surface of the outer jacket contacting the exterior surface of the inner jacket, the outer jacket including channels formed in the interior surface of the outer jacket;

d) wherein each of the inner and outer jackets is concentrically located in relation to the central axis of the cable core.

13. The cable of claim 12, wherein each of the channels of the outer jacket has the same cross-sectional area.

14. The cable of claim 12, wherein the channels of the inner jacket and the channels of the outer jacket have a generally square cross-sectional shape.

15. The cable of claim 12, wherein the channels of the inner jacket and the channels of the outer jacket have a triangular cross-sectional shape.

16. The cable of claim 12, wherein the channels of the outer jackets are equally spaced about the interior surface of the outer jacket.

17. The cable of claim 12, wherein the outer jacket has an outer diameter of between about 0.295 and 0.310 inches.

18. The cable of claim 17, wherein the inner jacket has an outer diameter of between about 0.236 and 0.250 inches.

19. The cable of claim 12, wherein each of the inner jacket and the outer jacket has a thickness of between about 0.030 and 0.036 inches.

20. The cable of claim 12, wherein the outer jacket includes between 18 and 26 channels formed in the interior surface of the outer jacket.

21. The cable of claim 12, wherein the cable core further includes a separator that separates at least some of the twisted pairs from others of the twisted pairs.

22. The cable of claim 21, wherein the separator includes a flexible tape strip.

23. A multi-pair cable, comprising:

a) a cable core including a plurality of twisted pairs, each of the twisted pairs including a first conductor surrounded by an insulating layer and a second conductor surrounded by an insulating layer, the cable core further including a flexible tape strip that separates at least some of the twisted pairs from others of the twisted pairs, the cable core defining a central axis;

b) an inner jacket surrounding the cable core, the inner jacket being made of an insulating plastic material, the inner jacket having an interior surface and an exterior surface; and c) an outer jacket surrounding the inner jacket, the outer jacket having an interior surface and an exterior surface, the interior surface of the outer jacket contacting the exterior surface of the inner jacket, the outer jacket including channels formed in the interior surface of the outer jacket;

d) wherein each of the inner and outer jackets is concentrically located in relation to one another.

* * * * *